US007852290B2

(12) United States Patent
Cho

(10) Patent No.: US 7,852,290 B2
(45) Date of Patent: Dec. 14, 2010

(54) PLASMA DISPLAY APPARATUS

(75) Inventor: Janghwan Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 698 days.

(21) Appl. No.: 11/864,034

(22) Filed: Sep. 28, 2007

(65) Prior Publication Data

US 2008/0079668 A1 Apr. 3, 2008

(30) Foreign Application Priority Data

Sep. 29, 2006 (KR) ..... 10-2006-0096595

(51) Int. Cl.
*G09G 3/28* (2006.01)

(52) U.S. Cl. ..... 345/60; 315/169.1

(58) Field of Classification Search ..... 345/60–70; 315/169.1–169.4
See application file for complete search history.

(56) References Cited

U.S. PATENT DOCUMENTS

| | | | | |
|---|---|---|---|---|
| 6,160,531 | A | 12/2000 | Chen et al. | 345/60 |
| 6,275,203 | B1 * | 8/2001 | Yamada | 345/60 |
| 7,027,010 | B2 * | 4/2006 | Lee | 345/60 |
| 7,064,732 | B2 * | 6/2006 | Van Der Broeck et al. | 345/60 |
| 7,652,639 | B2 * | 1/2010 | Lee | 345/60 |
| 2004/0207332 | A1 | 10/2004 | Cho et al. | 315/169.4 |
| 2005/0088376 | A1 * | 4/2005 | Inoue et al. | 345/60 |
| 2005/0116763 | A1 * | 6/2005 | Van Der Broeck et al. | 327/423 |
| 2005/0200565 | A1 * | 9/2005 | Nakamura | 345/60 |
| 2005/0219154 | A1 * | 10/2005 | Nakamura | 345/60 |
| 2005/0219155 | A1 * | 10/2005 | Nakamura | 345/60 |

FOREIGN PATENT DOCUMENTS

| | | |
|---|---|---|
| EP | 0 704 834 | 1/2001 |
| EP | 1 494 197 | 1/2005 |
| EP | 1 507 250 | 2/2005 |
| KR | 10-2003-0089957 A | 11/2003 |
| KR | 10-2004-0090585 A | 10/2004 |
| KR | 10-2006-0061158 A | 6/2006 |
| WO | WO 2004/097778 | 11/2004 |

OTHER PUBLICATIONS

European Office Action dated Dec. 20, 2007.
Korean Decision to Grant a Patent dated Dec. 20, 2007.

* cited by examiner

*Primary Examiner*—Nitin Patel
(74) *Attorney, Agent, or Firm*—KED & Associates, LLP

(57) ABSTRACT

A plasma display apparatus is disclosed. The plasma display apparatus includes a plasma display panel including first, second and third electrodes and a sustain driver. The sustain driver supplies a sustain signal swinging between a positive sustain voltage and a negative sustain voltage to the first electrode. The sustain driver supplies a voltage gradually falling from the positive sustain voltage or a voltage gradually rising from the negative sustain voltage to the first electrode during a second period following a first period when the positive sustain voltage or the negative sustain voltage is supplied. The sustain driver includes an inductor into which a current flows in the same direction during the first period and the second period.

23 Claims, 11 Drawing Sheets

PLASMA DISPLAY APPARATUS

This application claims the benefit of Korean Patent Application No. 10-2006-0096595 filed on Sep. 29, 2007, which is hereby incorporated by reference.

BACKGROUND OF THE DISCLOSURE

1. Field of the Disclosure

This document relates to a plasma display apparatus.

2. Description of the Related Art

A plasma display apparatus generally includes a plasma display panel displaying an image, and a driver attached to a rear surface of the plasma display panel to drive the plasma display panel.

The plasma display panel has the structure in which barrier ribs formed between a front substrate and a rear substrate form a plurality of discharge cells. Each discharge cell is filled with an inert gas containing a main discharge gas such as neon (Ne), helium (He) or a mixture of Ne and He, and a small amount of xenon (Xe). The plurality of discharge cells form one pixel. For instance, a red (R) discharge cell, a green (G) discharge cell, and a blue (B) discharge cell form one pixel.

When the plasma display panel is discharged by a high frequency voltage, the inert gas generates vacuum ultraviolet rays, which thereby cause phosphors formed between the barrier ribs to emit light, thus displaying an image. Since the plasma display panel can be manufactured to be thin and light, it has attracted attention as a next generation display device.

SUMMARY OF THE DISCLOSURE

In one aspect, a plasma display apparatus comprises a plasma display panel including a first electrode, a second electrode and a third electrode intersecting the first electrode and the second electrode, and a sustain driver that supplies a sustain signal swinging between a positive sustain voltage and a negative sustain voltage to the first electrode, supplies a voltage gradually falling from the positive sustain voltage or a voltage gradually rising from the negative sustain voltage to the first electrode during a second period following a first period when the positive sustain voltage or the negative sustain voltage is supplied, and includes an inductor into which a current flows in the same direction during the first period and the second period.

In another aspect, a plasma display apparatus comprises a plasma display panel including a first electrode and a second electrode positioned parallel to the first electrode, a first sustain controller that supplies a positive sustain voltage to the first electrode, a second sustain controller that supplies a negative sustain voltage to the first electrode, a resonance controller that supplies a voltage gradually falling from the positive sustain voltage or a voltage gradually rising from the negative sustain voltage to the first electrode during a second period following a first period when the positive sustain voltage or the negative sustain voltage is supplied, and an inductor unit into which a current flows in the same direction during the first period and the second period.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Figure 1:
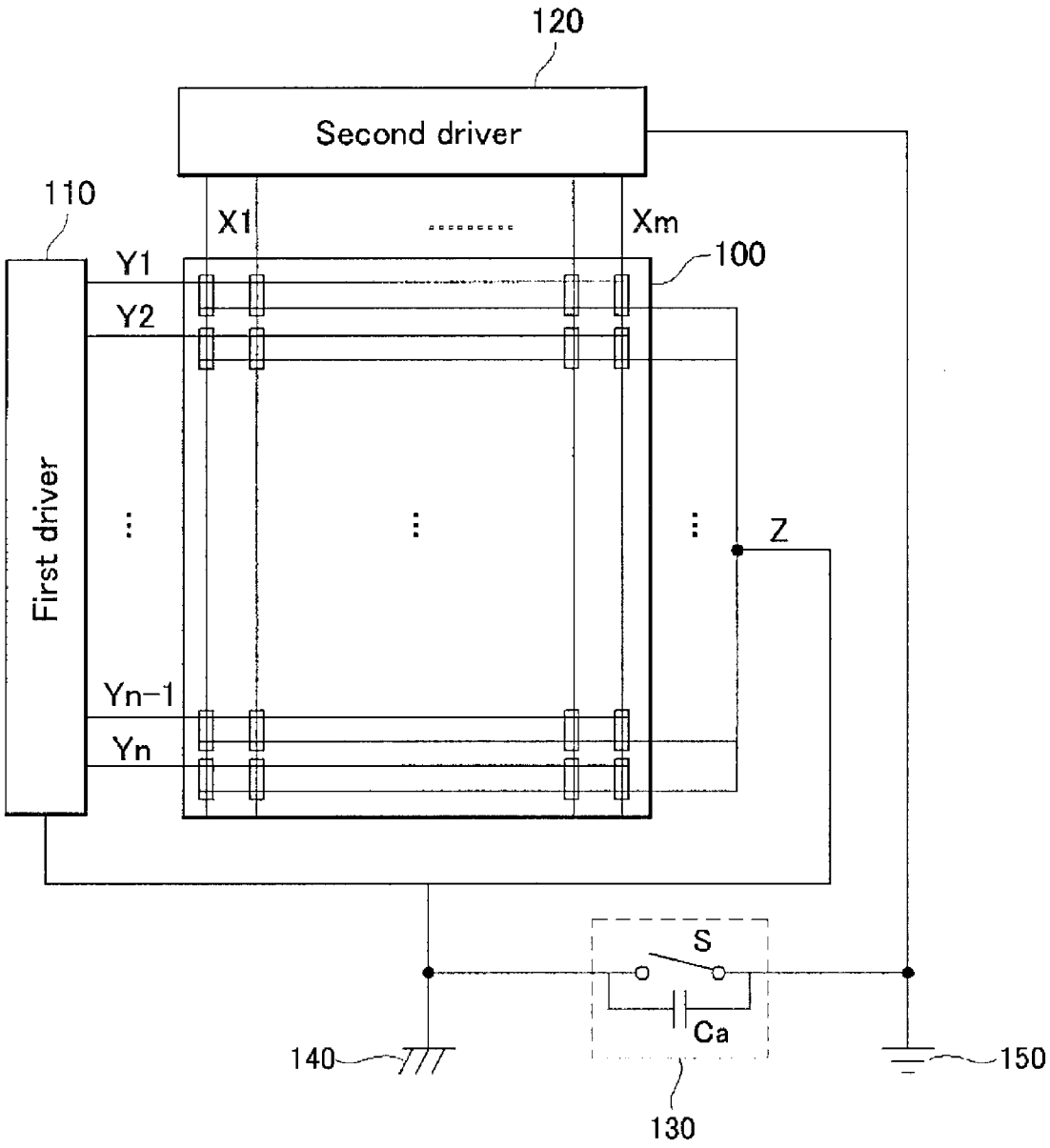
FIG. 1 illustrates a plasma display apparatus according to an exemplary embodiment.

A plasma display apparatus comprises a plasma display panel including a first electrode, a second electrode and a third electrode intersecting the first electrode and the second electrode, and a sustain driver that supplies a sustain signal swinging between a positive sustain voltage and a negative sustain voltage to the first electrode, supplies a voltage gradually falling from the positive sustain voltage or a voltage gradually rising from the negative sustain voltage to the first electrode during a second period following a first period when the positive sustain voltage or the negative sustain voltage is supplied, and includes an inductor into which a current flows in the same direction during the first period and the second period.

The plasma display apparatus may further comprise a data driver that supplies a data signal to the third electrode during an address period, and a reference separation controller that separates or connects a first reference voltage source commonly connected to the sustain driver and the second electrode from or to a second reference voltage source connected to the data driver.

While a voltage of the first electrode is maintained at the positive sustain voltage during a sustain period, the reference separation controller electrically may connect the first reference voltage source to the second reference voltage source and the data driver may not supply a driving voltage to the third electrode.

The sustain driver may change a direction of a current flowing into the inductor from a first direction to a second direction during a whole supply period of the positive sustain voltage. The sustain driver may change a direction of a current flowing into the inductor from the second direction to the first direction during a whole supply period of the negatives sustain voltage.

When the positive sustain voltage is supplied to the first electrode, a magnitude of a current flowing in the first direction may gradually decrease and a magnitude of a current flowing in the second direction may gradually increase.

After the positive sustain voltage is supplied to the first electrode, a current may flow into the inductor in the second direction when a voltage of the first electrode gradually falls from the positive sustain voltage to the negative sustain voltage.

When the negative sustain voltage is supplied to the first electrode, a magnitude of a current flowing in the second direction may gradually decrease and a magnitude of a current flowing in the first direction may gradually increase.

After the negative sustain voltage is supplied to the first electrode, a current may flow into the inductor in the first direction when a voltage of the first electrode gradually rises from the negative sustain voltage to the positive sustain voltage.

A magnitude of a current flowing into the inductor at a time when resonance occurs between the plasma display panel and the inductor may be larger than a magnitude of a current flowing into the inductor while a voltage of the first electrode is maintained at the positive sustain voltage or the negative sustain voltage.

A plasma display apparatus comprises a plasma display panel including a first electrode and a second electrode positioned parallel to the first electrode, a first sustain controller that supplies a positive sustain voltage to the first electrode, a second sustain controller that supplies a negative sustain voltage to the first electrode, a resonance controller that supplies a voltage gradually falling from the positive sustain voltage or a voltage gradually rising from the negative sustain voltage to the first electrode during a second period following a first period when the positive sustain voltage or the negative sustain voltage is supplied, and an inductor unit into which a current flows in the same direction during the first period and the second period.

The positive sustain voltage may be supplied to the first electrode during a turn-on period of the first sustain controller. A direction of a current flowing into the inductor unit may change from a first direction to a second direction during a whole supply period of the positive sustain voltage.

When the positive sustain voltage is supplied to the first electrode, a magnitude of a current flowing in the first direction may gradually decrease and a magnitude of a current flowing in the second direction may gradually increase.

During a turn-off period of the first sustain controller, a voltage of the first electrode may gradually fall from the positive sustain voltage to the negative sustain voltage and a direction of a current flowing into the inductor unit may be maintained in the second direction.

A magnitude of a current flowing into the inductor unit in the second direction at a time when resonance occurs between the plasma display panel and the inductor unit may be larger than a magnitude of a current flowing into the inductor unit in the second direction while a voltage of the first electrode is maintained at the positive sustain voltage.

The negative sustain voltage may be supplied to the first electrode during a turn-on period of the second sustain controller. A direction of a current flowing into the inductor unit may change from a second direction to a first direction during a whole supply period of the negative sustain voltage.

When the negative sustain voltage is supplied to the first electrode, a magnitude of a current flowing in the second direction may gradually decrease and a magnitude of a current flowing in the first direction may gradually increase.

During a turn-off period of the second sustain controller, a voltage of the first electrode may gradually rise from the negative sustain voltage to the positive sustain voltage and a direction of a current flowing into the inductor unit may be maintained in the first direction.

A magnitude of a current flowing into the inductor unit in the first direction at a time when resonance occurs between the plasma display panel and the inductor unit may be larger than a magnitude of a current flowing into the inductor unit in the first direction while a voltage of the first electrode is maintained at the positive sustain voltage.

The resonance controller may be turned off during a turn-on period of the first sustain controller at a time when a magnitude of a current flowing into the inductor unit is 0 ampere.

A duration of the turn-on period of the first sustain controller may be proportional to a duration of a period when a voltage of the first electrode is maintained at the positive sustain voltage.

A magnitude of a current flowing into the inductor unit may be 0 ampere during a turn-off period of the resonance controller.

The resonance controller may be turned off while a current flows into the inductor unit.

The plasma display apparatus may further comprise a bypass unit that allows a current flowing into the inductor unit to flow into the first sustain controller during a turn-off period of the resonance controller.

Embodiments will be described in a more detailed manner with reference to the drawings.

FIG. 1 illustrates a plasma display apparatus according to an exemplary embodiment.

As illustrated in FIG. 1, a plasma display apparatus according to an exemplary embodiment includes a plasma display panel 100, a first driver 110, a second driver 120, and a reference separation controller 130.

The plasma display panel 100 includes first electrodes Y1-Yn, second electrodes Z, and third electrodes X1-Xm intersecting the first electrodes Y1-Yn and the second electrodes Z. The first electrodes Y1-Yn are electrically connected to one terminal of the first driver 110, and the second electrodes Z and the other terminal of the first driver 110 are electrically connected to a first reference voltage source 140. One terminal of the second driver 120 is electrically connected to the third electrodes X1-Xm, and the other terminal is electrically connected to a second reference voltage source 150.

The reference separation controller 130 is electrically connected between the first reference voltage source 140 and the second reference voltage source 150.

The first driver 110 includes a sustain driver and drives the first electrodes Y1-Yn. The sustain driver supplies sustain signals for displaying an image to the first electrodes Y1-Yn.

The first driver 110 may supply a reset signal to the first electrodes Y1-Yn to initialize wall charges distributed inside discharge cells. Further, the first driver 110 may supply a scan reference voltage and a scan signal, which select the discharge cells to emit light, to the first electrodes Y1-Yn.

voltage sources of the first driver 110 supply voltages based on the first reference voltage source 140. For instance, a sustain voltage source for supplying a sustain signal and a setup voltage source for supplying a setup signal of a reset signal, and the like, supply voltages based on the first reference voltage source 140.

The first reference voltage source 140 may be formed in a predetermined area using an electrically conductive material. Examples of the first reference voltage source 140 include a frame, a cooper foil having a predetermined area, and an electrically conductive material attached to a case of the plasma display apparatus.

The second driver 120 includes a data driver and supplies data signals to the third electrodes X1-Xm.

A data voltage source of the second driver 120 supplies a data voltage of the data signal based on the second reference voltage source 150. The second reference voltage source 150 may produce a second reference voltage while being electrically separated from the first reference voltage source 140. The second reference voltage source 150 may be variously formed in the same way as the first reference voltage source 140. The second reference voltage source 150 may be one of examples of the first reference voltage source 140 and different from the first reference voltage source 140.

The reference separation controller 130 electrically separates or connects the first reference voltage source 140 connected to the sustain driver from or to the second reference voltage source 150 connected to the data driver. The reference separation controller 130 may include a parasitic capacitor Ca of a switch (S).

When the reference separation controller 130 separates the first reference voltage source 140 from the second reference voltage source 150 during a sustain period, there occurs a voltage difference between the first reference voltage source 140 and the second reference voltage source 150. Hence, the third electrodes X1-Xm are floated. An opposite discharge is suppressed due to a floating voltage produced by the third electrodes X1-Xm of a floating state depending on the supplying of a sustain signal, and a damage to a phosphor is prevented. A discharge efficiency and a driving efficiency can be improved by preventing the damage to the phosphor, and life span of the plasma display apparatus can increase.

FIG. 1 described an operation of the sustain driver in a state in which the first reference voltage source 140 is separated from the second reference voltage source 150. However, the operation of FIG. 1 may be applied to an operation of the sustain driver in a state in which the first reference voltage source 140 is connected to the second reference voltage source 150.

Figure 2:
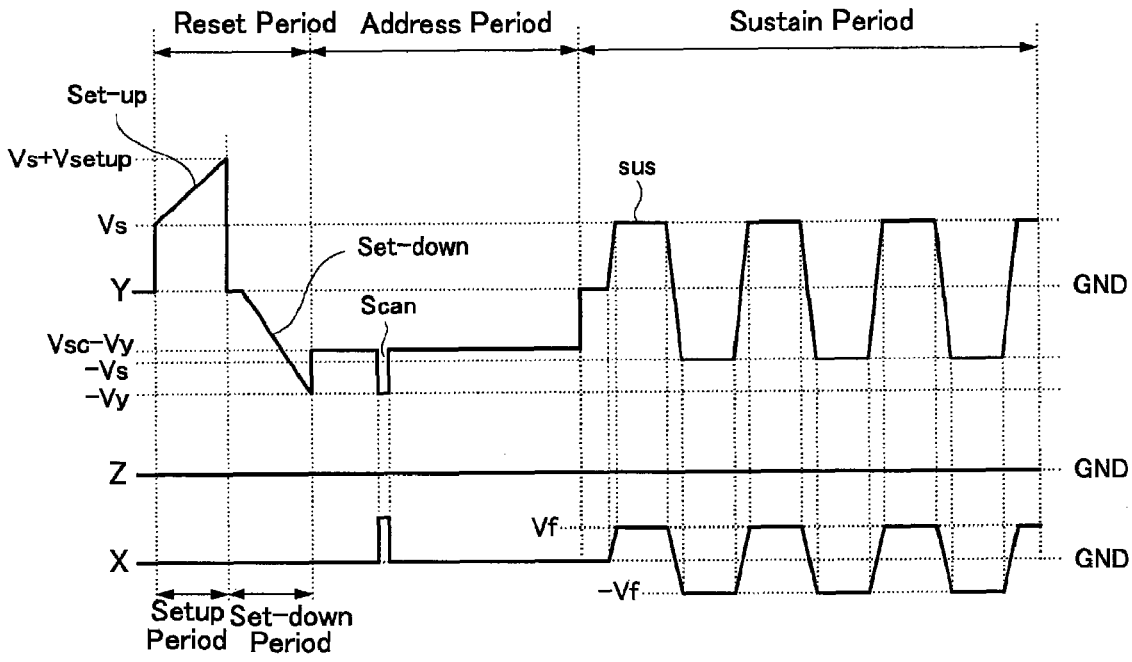
FIG. 2 illustrates a method of driving a plasma display panel.

FIG. 2 illustrates a method of driving a plasma display panel.

As illustrated in FIG. 2, the first and second drivers 110 and 120 of FIG. 1 supply driving signals to the first electrode Y and the third electrode X during a reset period, an address period and a sustain period. The reset period is divided into a setup period and a set-down period. During the setup period, the first driver 110 may supply a setup signal (Set-up) to the first electrode Y. The setup signal generates a weak dark discharge within the discharge cells. This results in wall charges of a positive polarity being accumulated on the second electrode Z and the third electrode X, and wall charges of a negative polarity being accumulated on the first electrode Y.

During the set-down period, the first driver 110 may supply a set-down signal (Set-down), which falls from a positive voltage lower than a highest voltage (Vs+Vsestup) of the setup signal (Set-up) to a given voltage lower than a ground level voltage GND, to the first electrode Y, thereby generating a weak erase discharge within the discharge cells. Furthermore, the remaining wall charges are uniform inside the discharge cells to the extent that the address discharge can be stably performed.

During the address period, the first driver 110 may supply a scan signal (Scan) of a negative polarity falling from a scan bias voltage (Vsc−Vy) to the first electrode Y. The data driver of the second driver 120 may supply a data signal of a positive polarity corresponding to the scan signal (Scan) to the third electrode X. As a voltage difference between the scan signal (Scan) and the data signal is added to the wall voltage generated during the reset period, an address discharge occurs within the discharge cells to which the data signal is applied.

During the sustain period, the sustain driver of the first driver 110 may supply a sustain signal (sus), which swings between a positive sustain voltage Vs and a negative sustain voltage −Vs, to the first electrode Y. Since the second electrode Z is connected to the first reference voltage source 140 of FIG. 1, a voltage of the second electrode Z is the ground level voltage GND.

While a voltage of the first electrode Y is maintained at the positive sustain voltage Vs or the negative sustain voltage −Vs during the sustain period, the switch S of the reference separation controller 130 is turned on. Hence, the reference separation controller 130 electrically connects the first reference voltage source 140 to the second reference voltage source 150. As a result, the data driver does not supply a driving voltage to the third electrode X, and the third electrode X is floated.

A voltage of the third electrode X in the floating sate is affected by a voltage of the first electrode Y, and swings between a positive voltage Vf and a negative voltage −Vf. The positive voltage Vf and the negative voltage −Vf of the third electrode X suppress an opposite discharge. A damage to the phosphor inside the discharge cell is prevented due to the suppression of the opposite discharge, and life span of the plasma display panel can increase.

Although it is not shown in FIG. 2, an erase period may be added in the exemplary embodiment.

Figure 3:
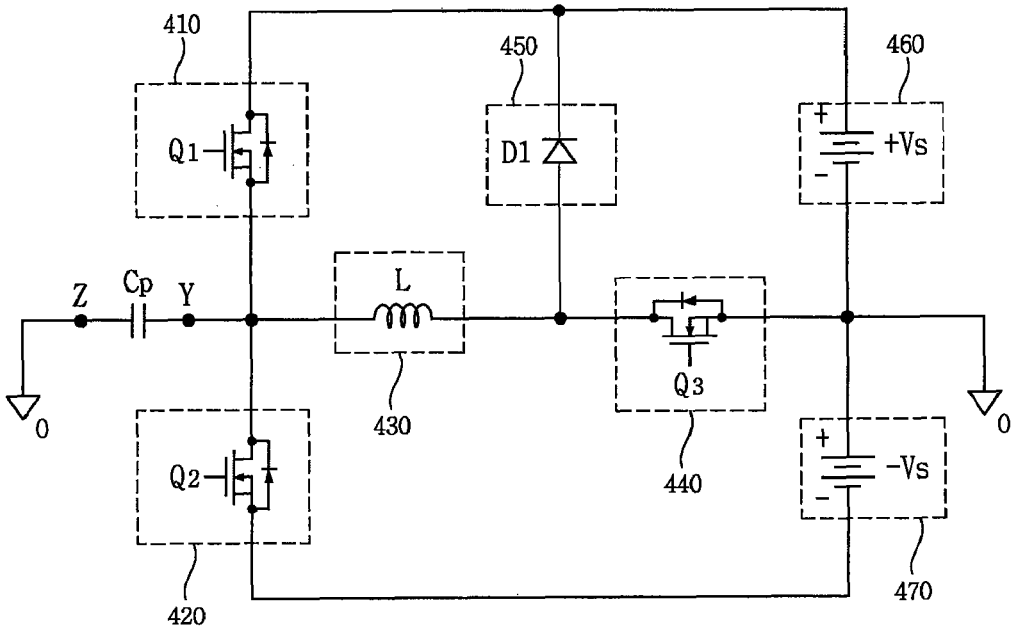
FIG. 3 illustrates a sustain driver included in a first driver.

FIG. 3 illustrates a sustain driver included in a first driver. As illustrated in FIG. 3, the sustain driver includes a first sustain controller 410, a second sustain controller 420, an inductor unit 430, a resonance controller 440, and a bypass unit 450. The second electrode Z is connected to the first reference voltage source 140.

The first sustain controller 410 receives a positive sustain voltage +Vs from a positive constant voltage source 460, and then supplies the positive sustain voltage +Vs to the first electrode Y. One terminal of the first sustain controller 410 is connected to the first electrode Y, and the other terminal is connected to the positive constant voltage source 460. The first sustain controller 410 includes a first sustain switch Q1. When the first sustain switch Q1 is turned on, the positive sustain voltage +Vs is supplied to the first electrode Y.

The second sustain controller 420 receives a negative sustain voltage −Vs from a negative constant voltage source 470, and then supplies the negative sustain voltage −Vs to the first electrode Y. One terminal of the second sustain controller 420 is commonly connected to the first electrode Y and one terminal of the first sustain switch Q1, and the other terminal is connected to the negative constant voltage source 470. The second sustain controller 420 includes a second sustain switch Q2. When the second sustain switch Q2 is turned on, the negative sustain voltage −Vs is supplied to the first electrode Y.

The resonance controller 440 supplies a voltage gradually falling from the positive sustain voltage +Vs or a voltage gradually rising from the negative sustain voltage −Vs to the first electrode Y during a second period following a first period when the positive sustain voltage +Vs or the negative sustain voltage −Vs is supplied to the first electrode Y.

The inductor unit 430 and the plasma display panel Cp form resonance. When the inductor unit 430 and the plasma display panel Cp form resonance, a voltage of the first electrode Y gradually falls from the positive sustain voltage +Vs to the negative sustain voltage −Vs or gradually rises from the negative sustain voltage −Vs to the positive sustain voltage +Vs.

A current flows into the inductor unit 430 in the same direction during the first and second periods. In other words, energy is supplied to the inductor unit 430 during the first period before a voltage of a sustain signal rises or falls due to the resonance between the inductor unit 430 and the plasma display panel Cp, and thus a voltage rise period or a voltage fall period of the sustain signal is reduced. Hence, a driving margin during a sustain period is improved and a discharge characteristic of the plasma display panel Cp is improved.

The voltage rise period of the sustain signal is a period during which a voltage of the first electrode Y gradually rises from the negative sustain voltage −Vs to the positive sustain voltage +Vs. The voltage fall period of the sustain signal is a period during which a voltage of the first electrode Y gradually falls from the positive sustain voltage +Vs to the negative sustain voltage −Vs.

The inductor unit 430 includes an inductor L. One terminal of the inductor L is commonly connected to the first electrode Y, one terminal of the first sustain switch Q1 and one terminal of the second sustain switch Q2.

When the first sustain controller 410 and the second sustain controller 420 are turned off, the resonance controller 440 is turned on. Hence, resonance is formed between the inductor unit 430 and the plasma display panel Cp.

The resonance controller 440 is turned off during a turn-on period of the first sustain controller 410 at a time when a magnitude of a current flowing into the inductor unit 430 is 0 ampere. Further, the resonance controller 440 may be turned on during a turn-off period of the first sustain controller 410.

Since the first sustain controller 410 is turned on during a period (i.e., a positive sustain voltage maintenance period) when the sustain signal is maintained at the positive sustain voltage Vs and a duration of the positive sustain voltage maintenance period is proportional to a duration of a turn-off period of the resonance controller 440, the duration of the positive sustain voltage maintenance period can be controlled.

Since a duration of a positive sustain voltage maintenance period of some sustain signals among a plurality of sustain signals is controlled, an image sticking phenomenon where wall charges distributed inside the discharge cells are stuck can be prevented.

When the first sustain controller 410 is turned on and the resonance controller 440 is turned off, a magnitude of a current flowing into the inductor unit 430 is 0 ampere. Thus, a circuit operation of the sustain driver is stabilized.

The resonance controller 440 includes a resonance switch Q3. One terminal of the resonance switch Q3 is connected to the other terminal of the inductor L, and the other terminal is commonly connected to the second electrode Z, the positive constant voltage source 460 and the negative constant voltage source 470.

The bypass unit 450 allows a current flowing into the inductor L to flow into the first sustain controller 410 during the turn-off period of the resonance controller 440. Thus, a circuit operation of the sustain driver is stabilized.

Figure 4:
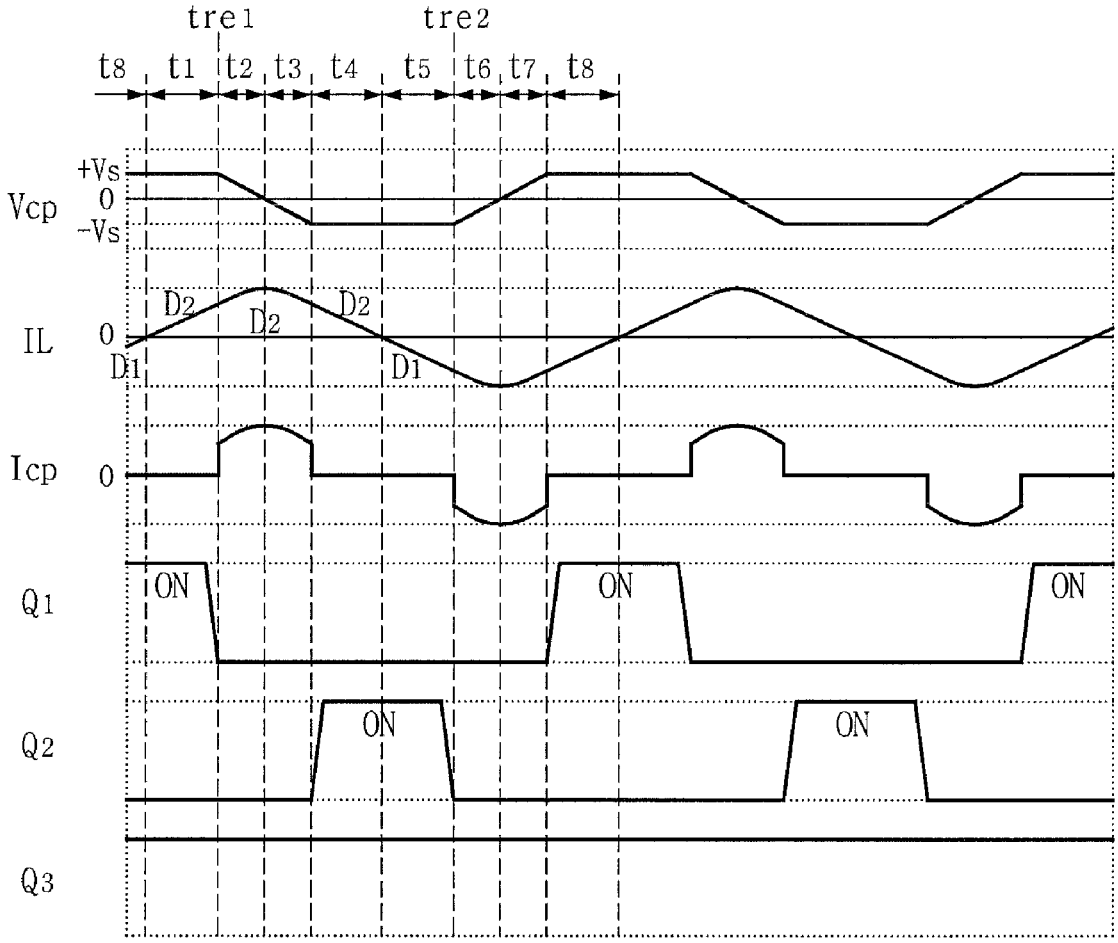
FIG. 4 is an operation timing diagram of the sustain driver of FIG. 3 during a sustain period.

FIG. 4 is an operation timing diagram of the sustain driver of FIG. 3 during a sustain period. In FIG. 4, Vcp indicates a voltage between the first electrode Y and the second electrode Z, i.e., a voltage of the sustain signal. Icp indicates a current entering the first electrode Y and the second electrode Z, and IL a current flowing into the inductor L. Q1, Q2 and Q3 indicate operation timings of the first sustain switch, the second sustain switch and the resonance switch, respectively.

The sustain driver changes a direction of a current IL flowing into the inductor L from a first direction D1 to a second direction D2 during a whole supply period (i.e., periods t1 and t8) of the positive sustain voltage +Vs. The positive sustain voltage (+Vs) is supplied to the first electrode Y during the turn-on period of the first sustain controller 410 of FIG. 3, and a direction of the current IL flowing into the inductor L changes from the first direction D1 to the second direction D2 during the supply periods t1 and t8 of the positive sustain voltage +Vs.

During the periods t1 and t8 when the voltage Vcp of the sustain signal is maintained at the positive sustain voltage (+Vs), a magnitude of the current IL flowing into the inductor L in the first direction D1 gradually decreases, and then a magnitude of the current IL flowing into the inductor L in the second direction D2 gradually increases. A direction of the current IL flowing into the inductor L is maintained in the second direction D2 during periods t2 and t3 when the voltage Vcp of the sustain signal gradually falls from the positive sustain voltage +Vs to the negative sustain voltage −Vs.

A magnitude of the current IL flowing into the inductor L in the second direction D2 during the periods t2 and t3 is larger than a magnitude of the current IL flowing into the inductor L in the second direction D2 during the periods t1 and t8 due to resonance between the panel Cp and the inductor L. A magnitude of the current IL flowing into the inductor L at a time $t_{re1}$ when resonance occurs between the panel Cp and the inductor L is larger than a magnitude of the current IL flowing into the inductor L during the periods t1 and t8.

As above, energy is charged to the inductor L due to the current IL flowing into the inductor L during the periods t1 and t8, and energy of the inductor L previously charged during the period t2 is discharged due to the resonance. Hence, a voltage fall period is reduced.

The sustain driver changes a direction of the current IL flowing into the inductor L from the second direction D2 to the first direction D1 during a whole supply period (i.e., periods t4 and t5) of the negative sustain voltage −Vs. A magnitude of the current IL flowing into the inductor L in the first direction D1 during periods t6 and t7 when the voltage Vcp of the sustain signal gradually rises from the negative sustain voltage −Vs to the positive sustain voltage +Vs is larger than a magnitude of the current IL flowing into the inductor L in the first direction D1 during the periods t4 and t5 when the voltage Vcp of the sustain signal is maintained at the negative sustain voltage −Vs.

A magnitude of the current IL flowing into the inductor L at a time $t_{re2}$ when resonance occurs between the panel Cp and the inductor L is larger than a magnitude of the current IL flowing into the inductor L during the periods t4 and t5.

As above, energy is charged to the inductor L due to the current IL flowing into the inductor L during the periods t4 and t5, and energy of the inductor L previously charged when the voltage Vcp of the sustain signal rises is discharged. Hence, a voltage rise period is reduced.

In other words, the sustain driver supplies a voltage gradually falling from the positive sustain voltage +Vs or a voltage gradually rising from the negative sustain voltage −Vs to the first electrode Y during a second period (i.e., the periods t2 and t6) following a first period (i.e., the periods t1 and t5) when the positive sustain voltage +Vs or the negative sustain voltage −Vs is supplied. In this case, the sustain driver includes the inductor L into which a current flows in the same direction during the first and second periods. For instance, a current may flow into the inductor L in the second direction D2 during the periods t1 and t2, and a current may flow into the inductor L in the first direction D1 during the periods t5 and t6.

Figure 5A:
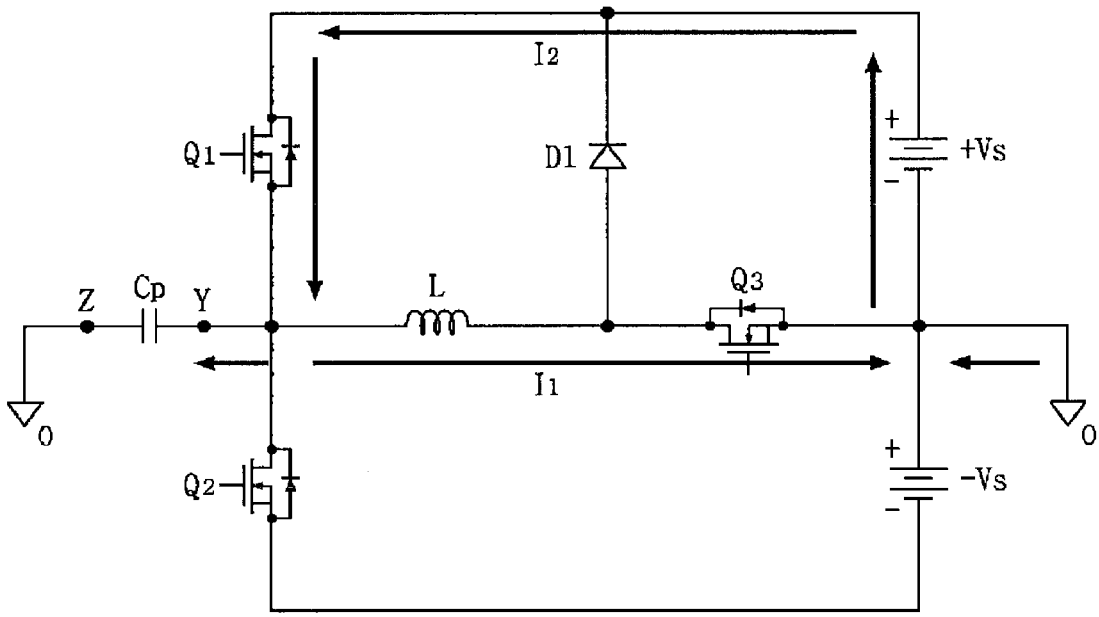
FIG. 5A to 5F illustrate an operation of the sustain driver depending on the operation timing diagram of FIG. 4.
Figure 5A:
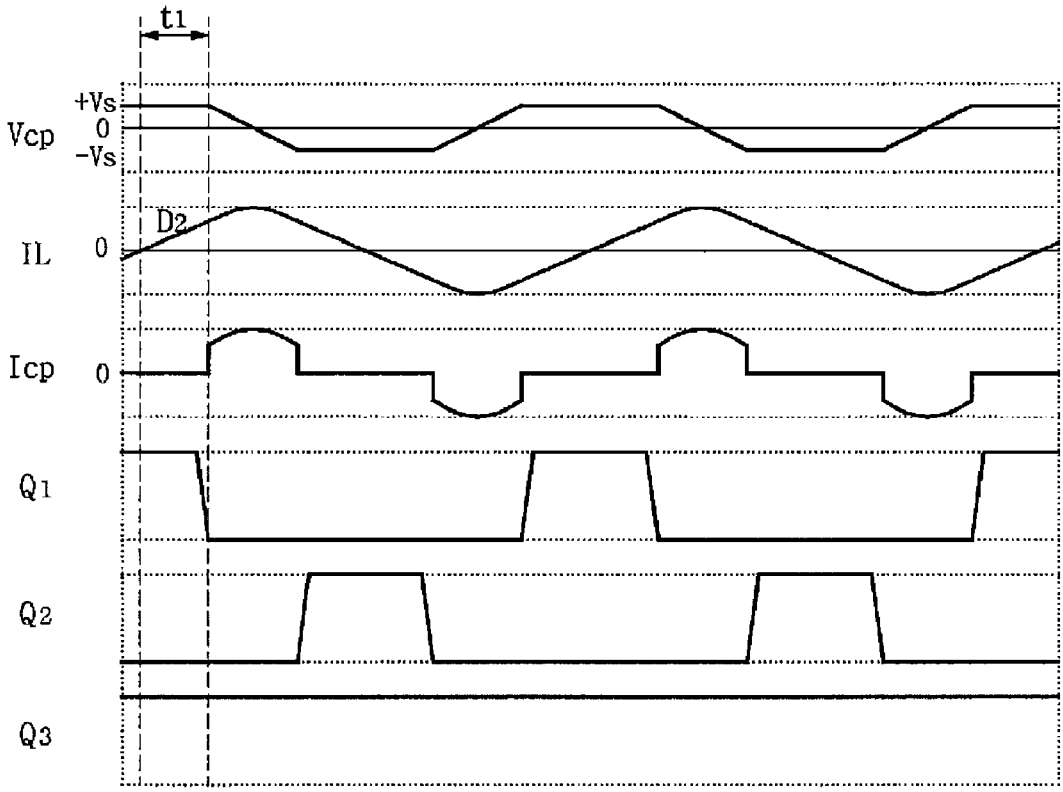

As illustrated in FIG. 5A, during the period t1, the first sustain switch Q1 and the resonance switch Q3 are turned on. The positive sustain voltage +Vs is supplied to the first electrode Y. The resonance switch Q3 is maintained in a turn-on state during a sustain period. Hence, energy loss caused by a switching operation of the resonance switch Q3 is reduced. A description of the switching operation of the resonance switch Q3 is omitted in FIGS. 5B to 5F.

During the period t1 when the voltage Vcp of the sustain signal is maintained at the positive sustain voltage +Vs, a current IL flows into the inductor L in the second direction D2. Hence, a first current path IT and a second current path I2 are formed during the period t1. The current IL flows into the inductor L in the second direction D2 along the first current path I1, and a magnitude of the current IL flowing in the second direction D2 gradually increases. Energy is charged to the inductor L by the gradually increasing current IL. The voltage Vcp of the first electrode Y is maintained at the positive sustain voltage +Vs through the second current path I2.

Figure 5B:
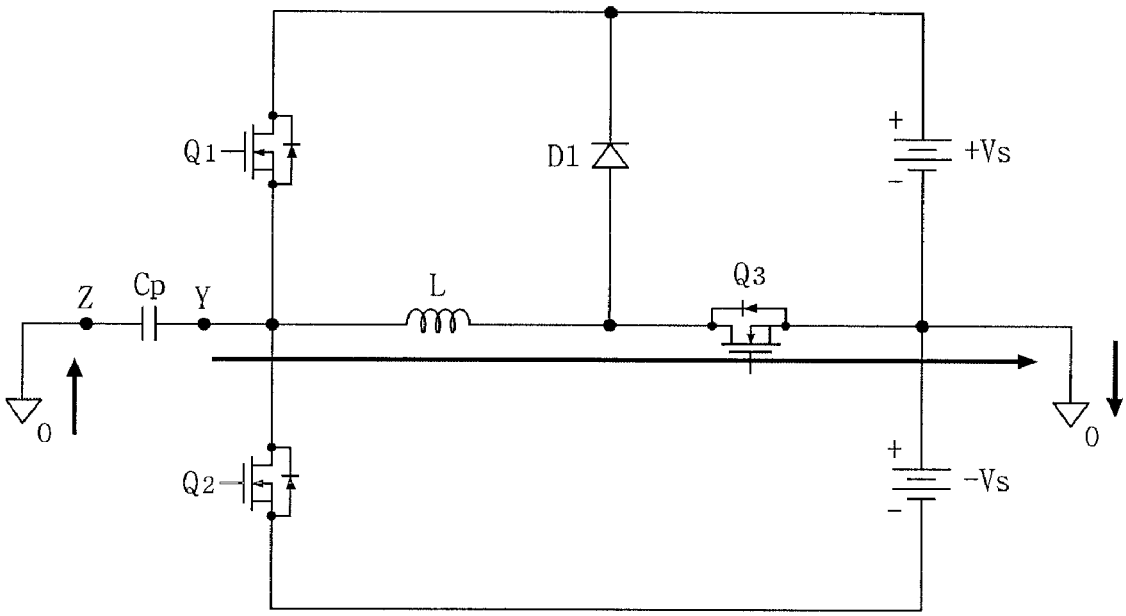
Figure 5B:
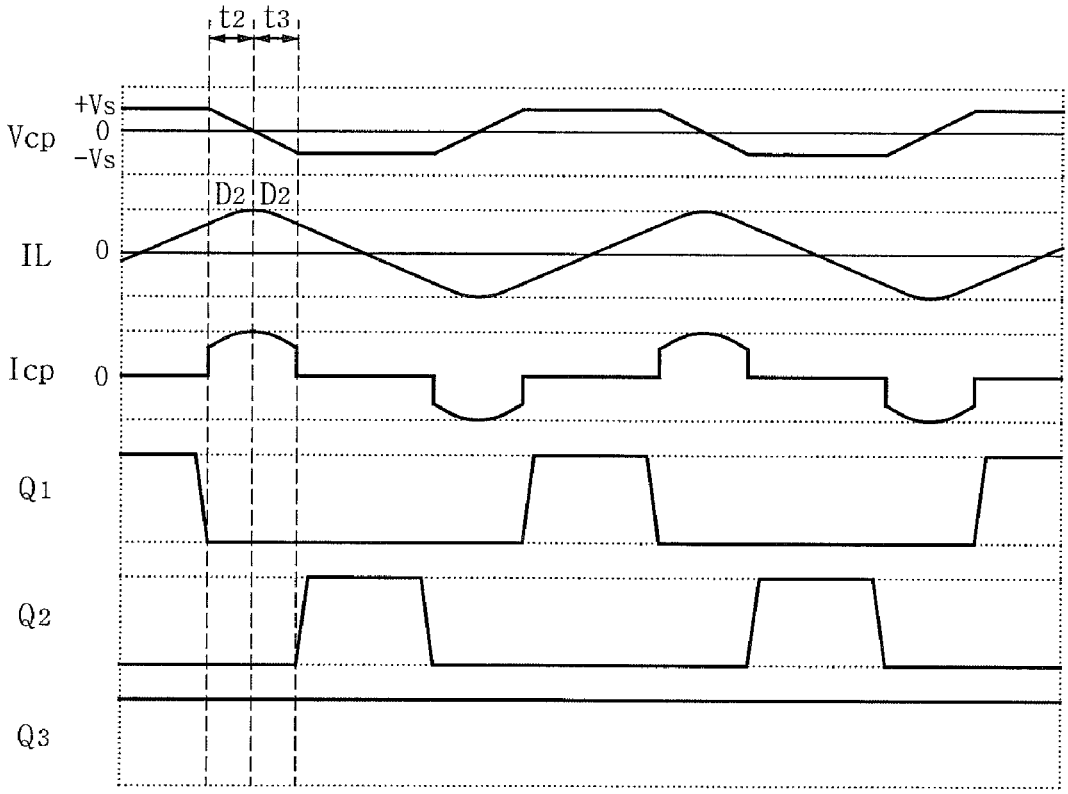

As illustrated in FIG. 5B, during the periods t2 and t3, the inductor L and the panel Cp forms resonance during a turn-off period of the first sustain switch Q1, and the voltage Vcp of the sustain signal gradually falls from the positive sustain voltage +Vs to the negative sustain voltage −Vs. The current IL flows into the inductor L in the second direction D2.

During the period t2, energy charged to the panel Cp is charged to the inductor L. Hence, a voltage magnitude of the sustain signal gradually decreases and the voltage Vcp of the sustain signal gradually falls.

During the period t3, energy charged to the inductor L is charged to the panel Cp. Hence, a voltage magnitude of the sustain signal gradually increases and the voltage Vcp of the sustain signal gradually falls. A direction of the current IL flowing into the inductor L during the periods t2 and t3 is the second direction D2. A magnitude of the current flowing into the inductor L in the second direction D2 during the periods t2 and t3 is larger than a magnitude of the current flowing into the inductor L in the second direction D2 during the period t1 of FIG. 5A.

Since energy is previously charged to the inductor L during the period t1, a magnitude of the current IL flowing into the inductor L increases due to resonance generated between the panel Cp and the inductor L. Hence, a voltage fall time (i.e., the periods t2 and t3) of the sustain signal is reduced. For instance, a voltage fall time of the sustain signal when a current flows into the inductor L during the period t1 is approximately equal to or less than one half of a voltage fall time of the sustain signal when a current does not flow into the inductor L during the period t1. Hence, a driving margin during a sustain period is improved.

When the voltage Vcp of the sustain signal falls from a ground level voltage to the negative sustain voltage −Vs during the period d3, a magnitude of the current IL flowing into the inductor L in the second direction D2 gradually decreases.

Figure 5C:
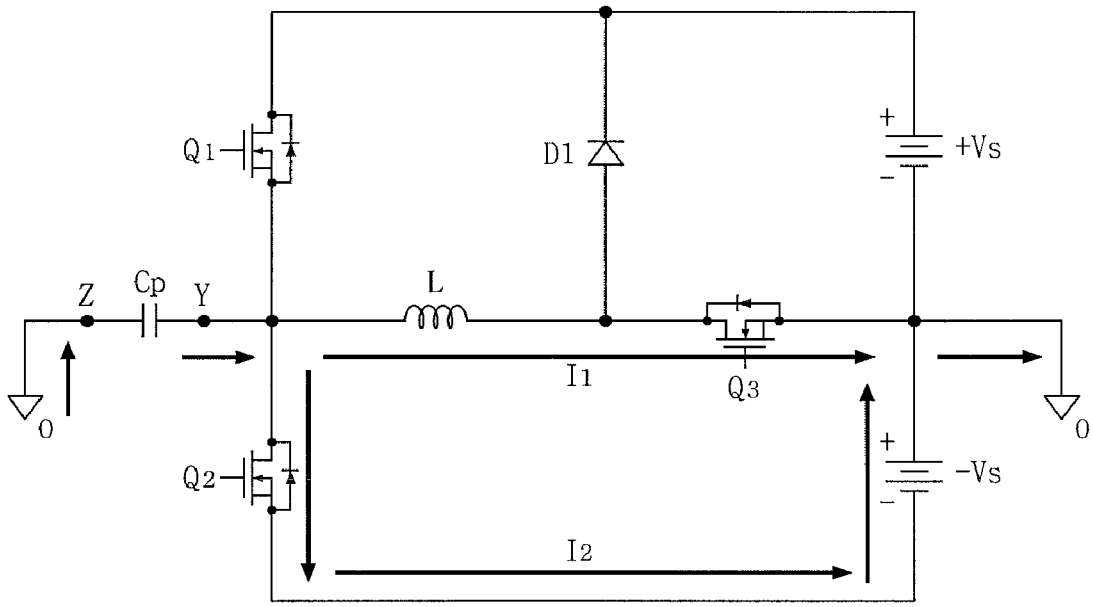
Figure 5C:
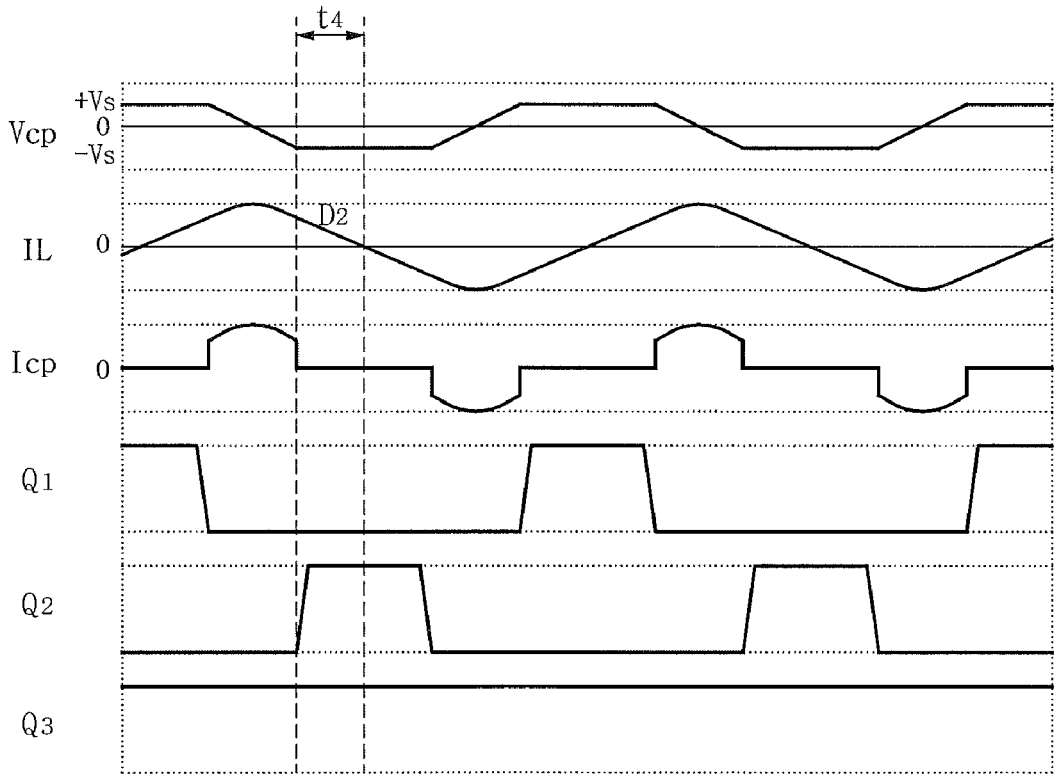

As illustrated in FIG. 5C, during the period t4, the second sustain switch Q2 is turned on. A magnitude of a current flowing into the inductor L in the second direction D2 along a first current path I1 gradually decreases until energy of the inductor L is discharged. The negative sustain voltage −Vs is supplied to the first electrode Y along a second current path I2.

Figure 5D:
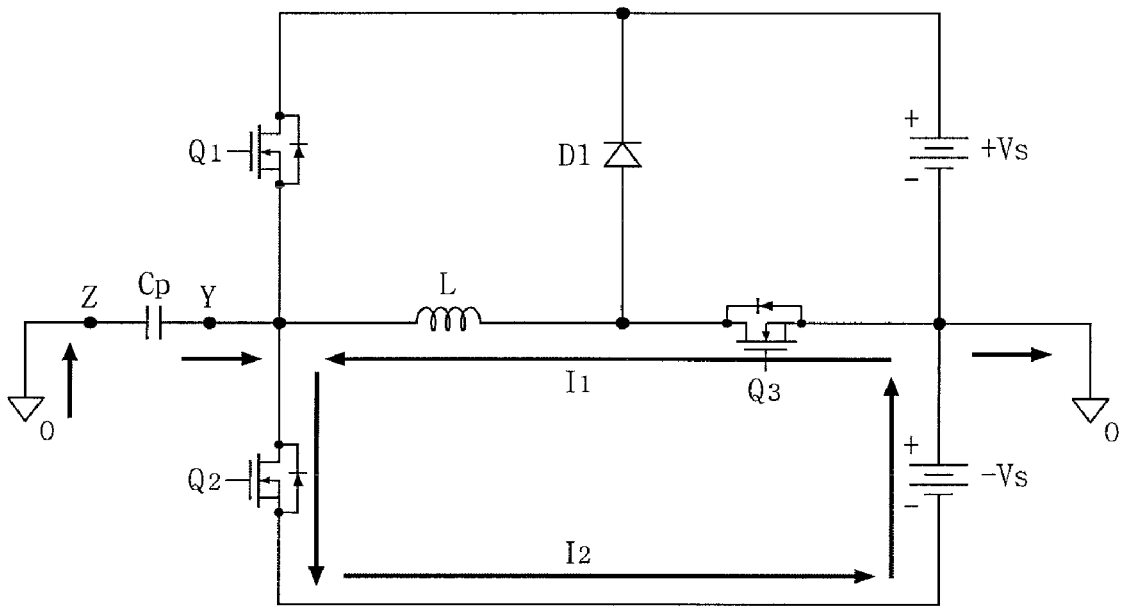
Figure 5D:
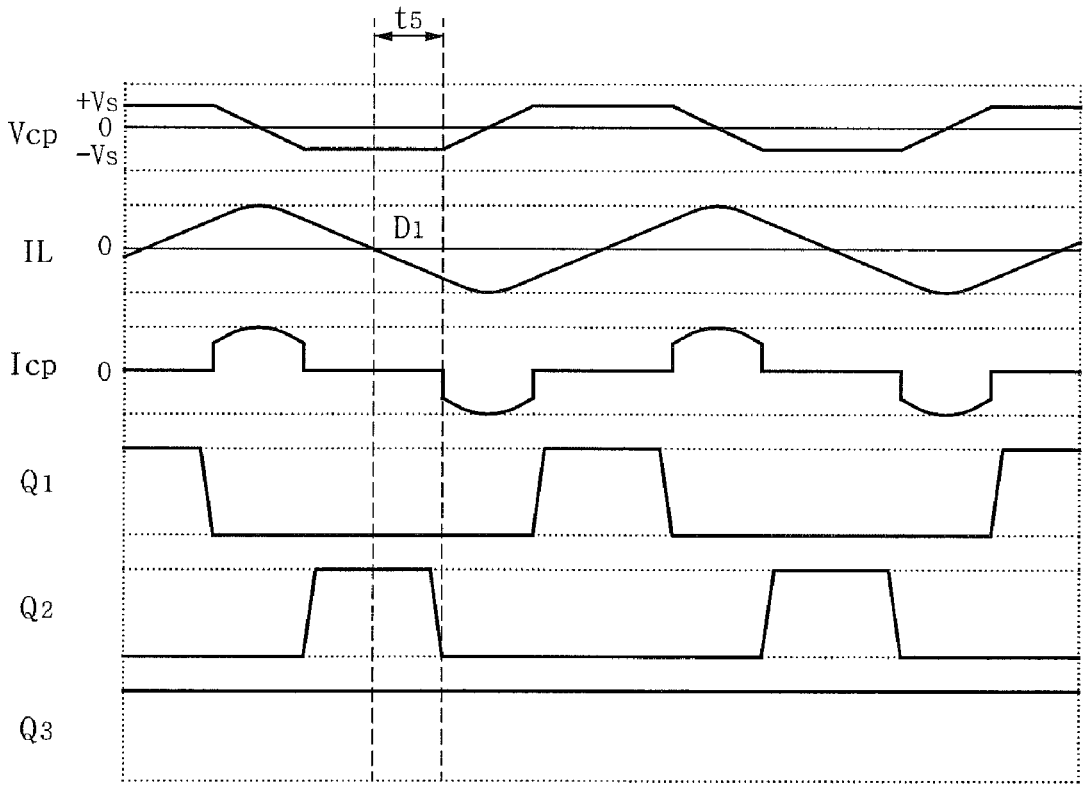

As illustrated in FIG. 5D, during the period t5, a direction of the current IL flowing into the inductor L along a first current path I1 changes from the second direction D2 to the first direction D1, and a magnitude of the current IL flowing in the first direction D1 gradually increases.

As illustrated in FIGS. 5C and 5D, the negative sustain voltage −Vs is supplied to the first electrode Y during the turn-on period of the second sustain switch Q2. A direction of the current IL flowing into the inductor L changes from the second direction D2 to the first direction D1 during the periods t4 and t5 when the negative sustain voltage −Vs is supplied.

Figure 5E:
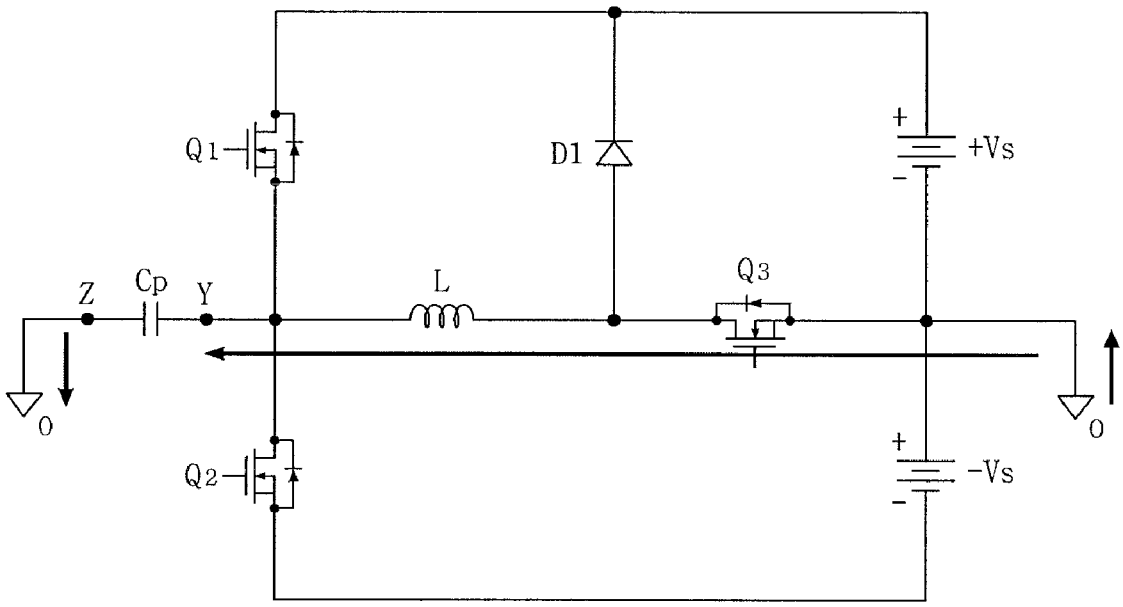
Figure 5E:
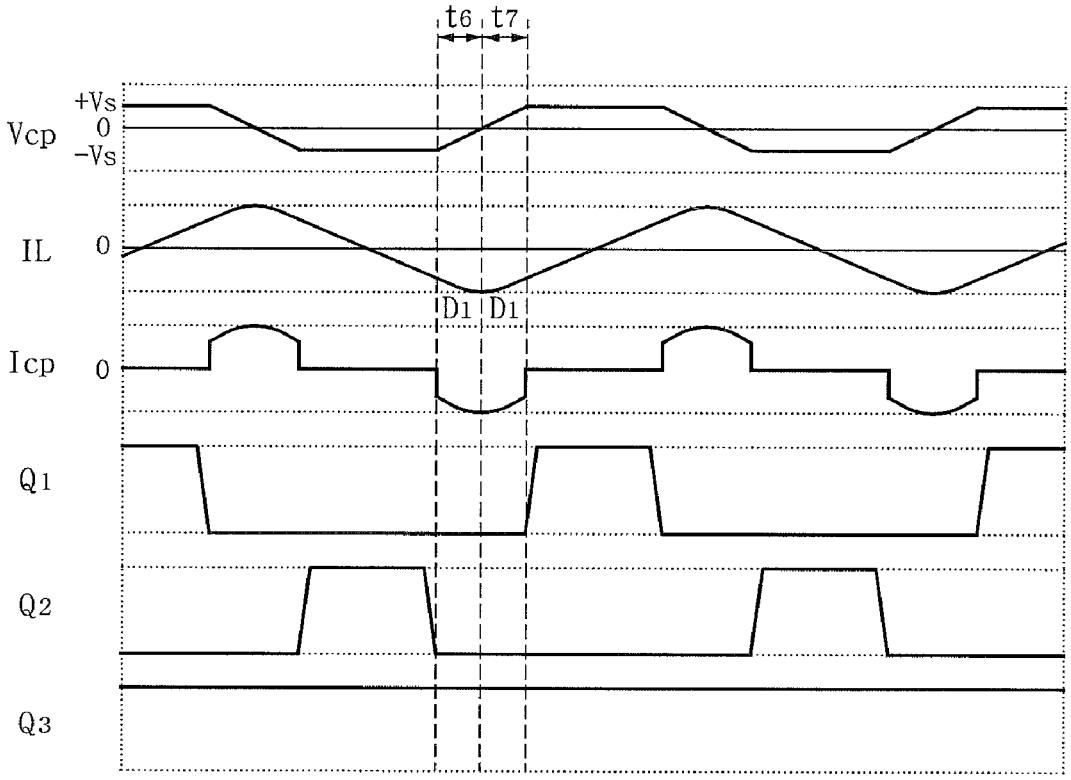

As illustrated in FIG. 5E, during the periods t6 and t7, the second sustain switch Q2 is turned off. Since the inductor L and the panel Cp form resonance, the voltage Vcp of the sustain signal gradually rises from the negative sustain voltage −Vs to the positive sustain voltage +Vs.

A direction of the current IL flowing into the inductor L during the periods t6 and t7 is maintained in the first direction D1. A magnitude of the current flowing into the inductor L in the first direction D1 during the periods t6 and t7 is larger than a magnitude of the current flowing into the inductor L in the first direction D1 during the period t5. Hence, a voltage rise time (i.e., the periods t6 and t7) of the sustain signal is reduced, and a driving margin during a sustain period is improved.

Figure 5F:
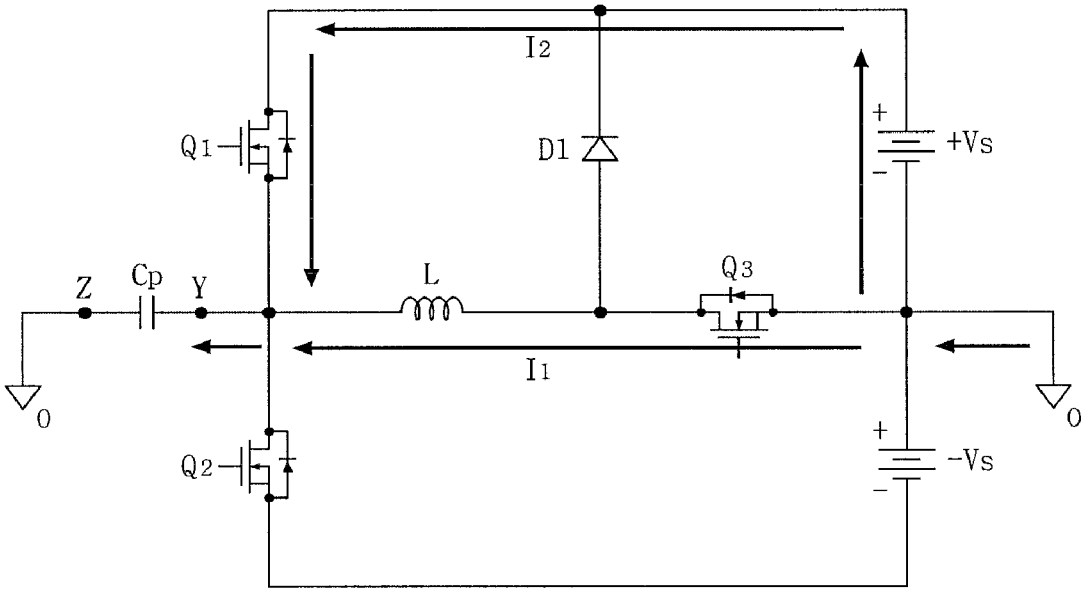
Figure 5F:
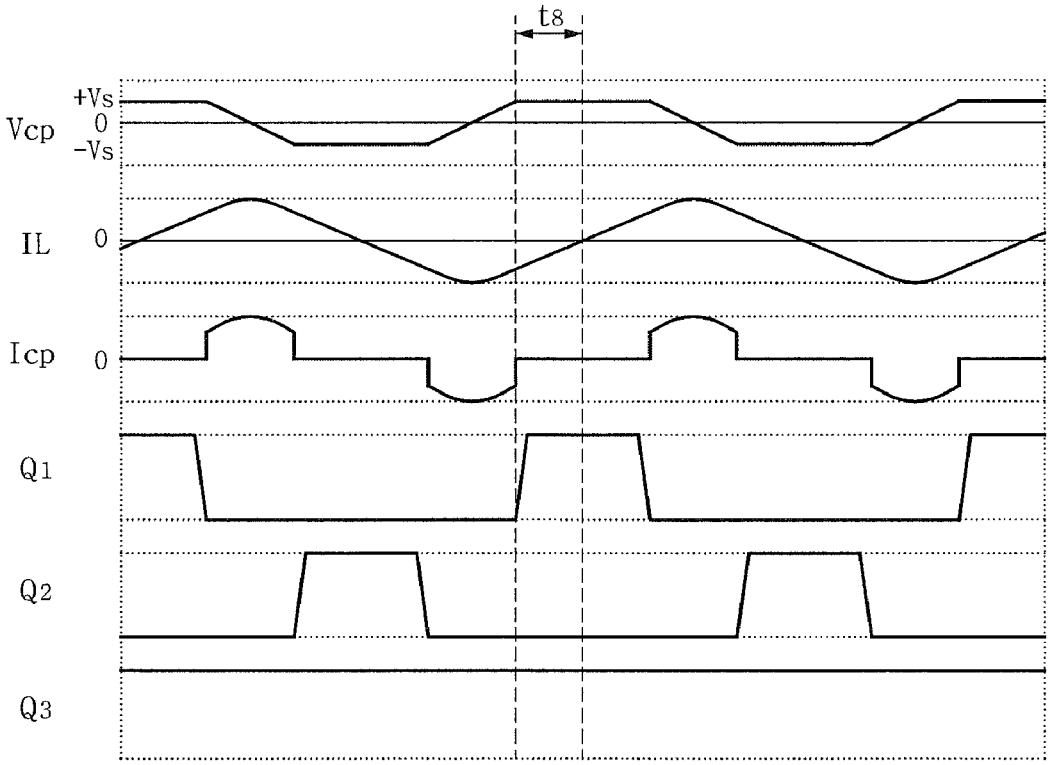

As illustrated in FIG. 5F, during the period t8, the first sustain switch Q1 is turned on. Hence, a first current path I1 and a second current path I2 are formed. A magnitude of the current IL flowing into the inductor L in the first direction D1 along the first current path I1 gradually decreases. The positive sustain voltage +Vs is supplied to the first electrode Y along the second current path I2.

After all the energy charged to the inductor L is discharged, a direction of the current IL flowing into the inductor L changes to the current direction during the period t1 of FIG. 5A.

Figure 6A:
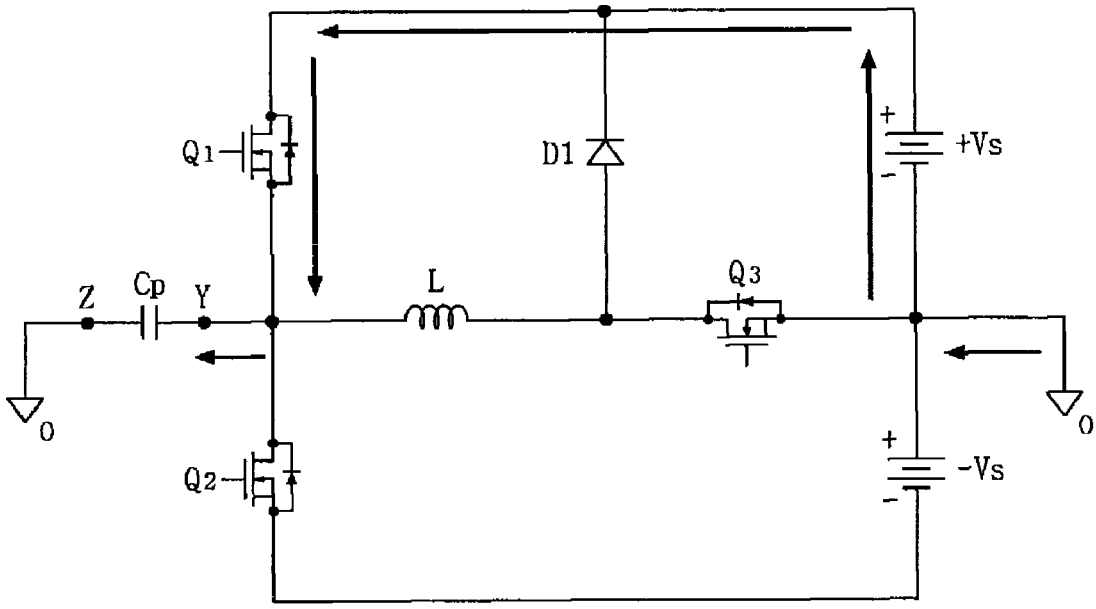
FIGS. 6A and 6B illustrate a method for controlling a supply period of a positive sustain voltage.
Figure 6A:
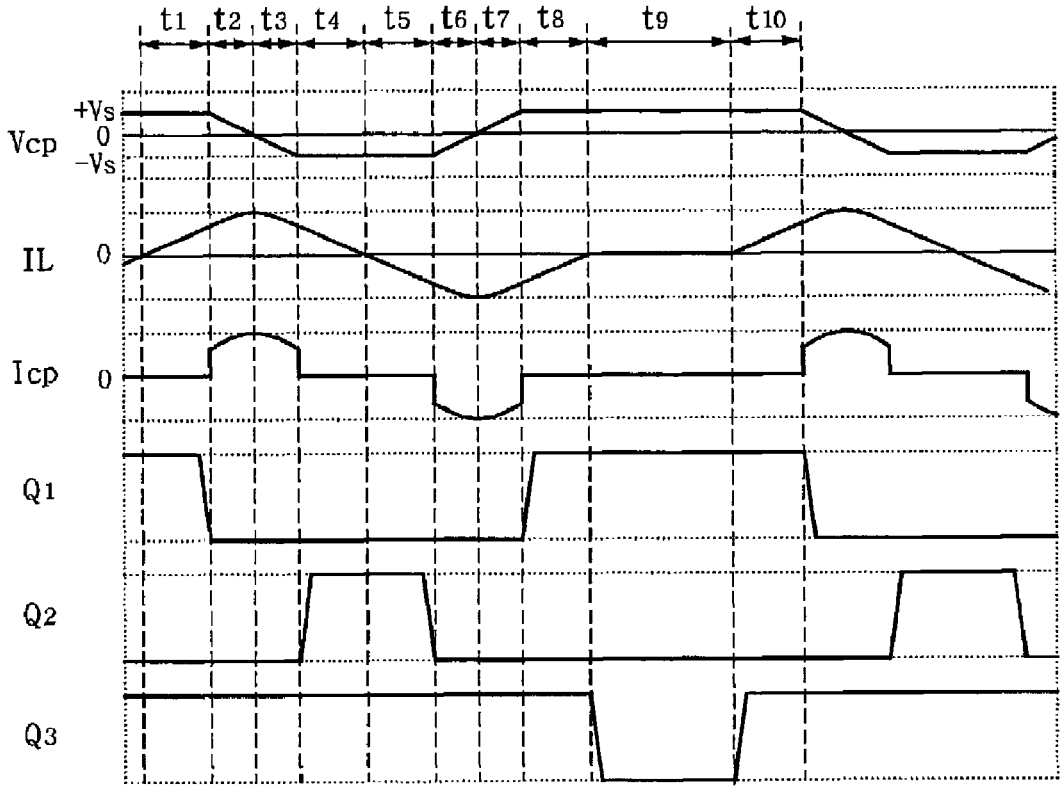
Figure 6B:
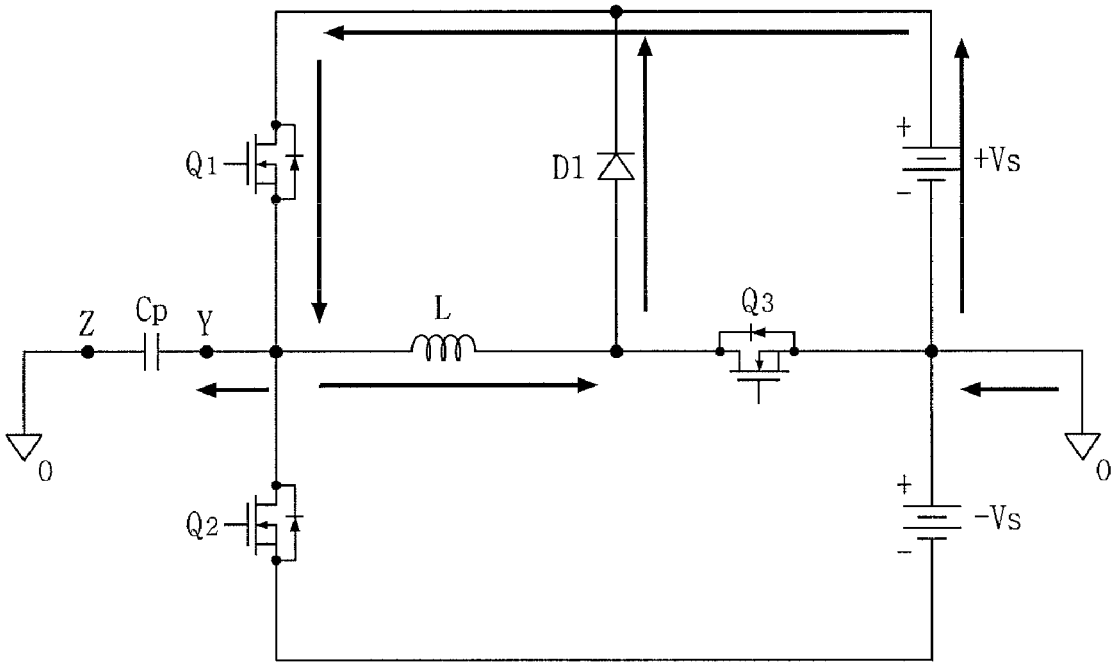

FIGS. 6A and 6B illustrate a method for controlling a supply period of a positive sustain voltage.

Since operations of the sustain driver during periods t1 to t8 in FIG. 6A are the same as the operations illustrated in FIGS. 5A to 5F, a description thereof is omitted.

As illustrated in FIG. 6A, during a period t9, the first sustain switch Q1 is maintained in a turn-on state, and the resonance switch Q3 is turned off at a time when a magnitude of the current IL flowing into the inductor L is 0 ampere. During a period t10, the switches Q1, Q2 and Q3 operate in the same way as the switches Q1, Q2 and Q3 illustrated in FIG. 5A.

The positive sustain voltage +Vs is supplied to the first electrode Y along a current path of FIG. 6A. Since a current does not flow into the inductor L during a turn-off period of the resonance switch Q3, a duration of a positive sustain voltage maintenance period is proportional to a duration of a turn-on period (i.e., the periods t8, t9 and t10) of the first sustain switch Q1. As above, since the positive sustain voltage maintenance period is controlled, image sticking displayed on an image of the plasma display panel can be prevented and a driving margin during a sustain period and a driving efficiency of the panel can be improved.

Further, the resonance switch Q3 may be turned off while a current flows into the inductor L, different from the period t9 of FIG. 6A. While a current in the first direction flows through an internal diode of the resonance switch Q3, a current in the second direction, as illustrated in FIG. 6B, flows into the first sustain switch Q1 through a bypass diode D1 of the bypass unit 450. Hence, the sustain driver can stably operate.

Figure 7:
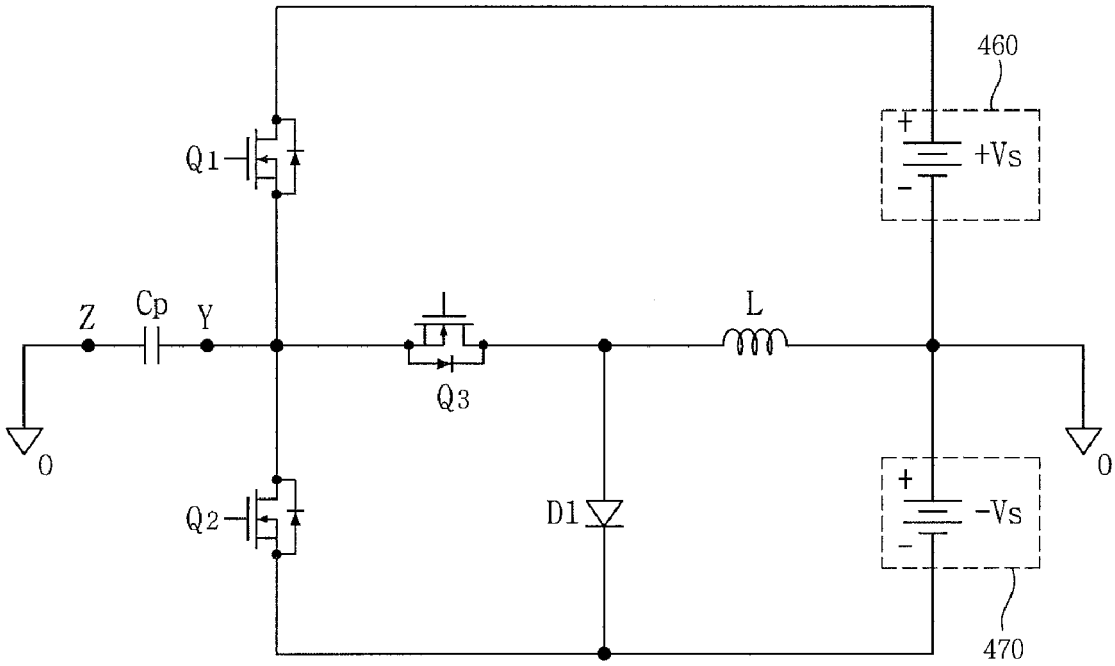
FIG. 7 illustrates another implementation of the sustain driver included in the first driver.

FIG. 7 illustrates another implementation of the sustain driver included in the first driver. As illustrated in FIG. 7, one terminal of the resonance switch Q3 is commonly connected to the first electrode Y, the first sustain switch Q1 and the second sustain switch Q2, and the other terminal is connected to one terminal of the inductor L. The other terminal of the inductor L is commonly connected to the second electrode Z, the positive constant voltage source 460 and the negative constant voltage source 470. A cathode of the bypass diode D1 is connected between the second sustain switch Q2 and the negative constant voltage source 470.

The sustain driver of FIG. 7 allows a current to continuously flow into the inductor during the supplying of a sustain signal in the same way as the sustain driver of FIGS. 5A to 5F. Further, the sustain driver of FIG. 7 allows a current not to flow into the inductor during the supplying of the negative sustain voltage −Vs to the first electrode Y in the same way as the sustain driver of FIGS. 6A and 6B, thereby increasing a duration of a negative sustain voltage maintenance period.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus comprising:

a plasma display panel including a first electrode, a second electrode and a third electrode intersecting the first electrode and the second electrode; and a sustain driver that supplies a sustain signal swinging between a positive sustain voltage and a negative sustain voltage to the first electrode, supplies a voltage gradually falling from the positive sustain voltage or a voltage gradually rising from the negative sustain voltage to the first electrode during a second period following a first period when the positive sustain voltage or the negative sustain voltage is supplied, and includes an inductor into which a current flows in the same direction during the first period and the second period.

2. The plasma display apparatus of claim 1, further comprising:

a data driver that supplies a data signal to the third electrode during an address period; and a reference separation controller that separates or connects a first reference voltage source commonly connected to the sustain driver and the second electrode from or to a second reference voltage source connected to the data driver.

3. The plasma display apparatus of claim 2, wherein while a voltage of the first electrode is maintained at the positive sustain voltage during a sustain period, the reference separation controller electrically connects the first reference voltage source to the second reference voltage source and the data driver does not supply a driving voltage to the third electrode.

4. The plasma display apparatus of claim 1, wherein the sustain driver changes a direction of a current flowing into the inductor from a first direction to a second direction during a whole supply period of the positive sustain voltage, and the sustain driver changes a direction of a current flowing into the inductor from the second direction to the first direction during a whole supply period of the negatives sustain voltage.

5. The plasma display apparatus of claim 4, wherein when the positive sustain voltage is supplied to the first electrode, a magnitude of a current flowing in the first direction gradually decreases and a magnitude of a current flowing in the second direction gradually increases.

6. The plasma display apparatus of claim 4, wherein after the positive sustain voltage is supplied to the first electrode, a current flows into the inductor in the second direction when a voltage of the first electrode gradually falls from the positive sustain voltage to the negative sustain voltage.

7. The plasma display apparatus of claim 4, when the negative sustain voltage is supplied to the first electrode, a magnitude of a current flowing in the second direction gradually decreases and a magnitude of a current flowing in the first direction gradually increases.

8. The plasma display apparatus of claim 4, wherein after the negative sustain voltage is supplied to the first electrode, a current flows into the inductor in the first direction when a voltage of the first electrode gradually rises from the negative sustain voltage to the positive sustain voltage.

9. The plasma display apparatus of claim 4, wherein a magnitude of a current flowing into the inductor at a time when resonance occurs between the plasma display panel and the inductor is larger than a magnitude of a current flowing into the inductor while a voltage of the first electrode is maintained at the positive sustain voltage or the negative sustain voltage.

10. A plasma display apparatus comprising:

a plasma display panel including a first electrode and a second electrode positioned parallel to the first electrode;

a first sustain controller that supplies a positive sustain voltage to the first electrode;

a second sustain controller that supplies a negative sustain voltage to the first electrode;

a resonance controller that supplies a voltage gradually falling from the positive sustain voltage or a voltage gradually rising from the negative sustain voltage to the first electrode during a second period following a first period when the positive sustain voltage or the negative sustain voltage is supplied; and an inductor unit into which a current flows in the same direction during the first period and the second period.

11. The plasma display apparatus of claim 10, wherein the positive sustain voltage is supplied to the first electrode during a turn-on period of the first sustain controller, and a direction of a current flowing into the inductor unit changes from a first direction to a second direction during a whole supply period of the positive sustain voltage.

12. The plasma display apparatus of claim 11, wherein when the positive sustain voltage is supplied to the first electrode, a magnitude of a current flowing in the first direction gradually decreases and a magnitude of a current flowing in the second direction gradually increases.

13. The plasma display apparatus of claim 11, wherein during a turn-off period of the first sustain controller, a voltage of the first electrode gradually falls from the positive sustain voltage to the negative sustain voltage and a direction of a current flowing into the inductor unit is maintained in the second direction.

14. The plasma display apparatus of claim 13, wherein a magnitude of a current flowing into the inductor unit in the second direction at a time when resonance occurs between the plasma display panel and the inductor unit is larger than a magnitude of a current flowing into the inductor unit in the second direction while a voltage of the first electrode is maintained at the positive sustain voltage.

15. The plasma display apparatus of claim 10, wherein the negative sustain voltage is supplied to the first electrode during a turn-on period of the second sustain controller, and a direction of a current flowing into the inductor unit changes from a second direction to a first direction during a whole supply period of the negative sustain voltage.

16. The plasma display apparatus of claim 15, wherein when the negative sustain voltage is supplied to the first electrode, a magnitude of a current flowing in the second direction gradually decreases and a magnitude of a current flowing in the first direction gradually increases.

17. The plasma display apparatus of claim 15, wherein during a turn-off period of the second sustain controller, a voltage of the first electrode gradually rises from the negative sustain voltage to the positive sustain voltage and a direction of a current flowing into the inductor unit is maintained in the first direction.

18. The plasma display apparatus of claim 17, wherein a magnitude of a current flowing into the inductor unit in the first direction at a time when resonance occurs between the plasma display panel and the inductor unit is larger than a magnitude of a current flowing into the inductor unit in the first direction while a voltage of the first electrode is maintained at the positive sustain voltage.

19. The plasma display apparatus of claim 10, wherein the resonance controller is turned off during a turn-on period of the first sustain controller at a time when a magnitude of a current flowing into the inductor unit is 0 ampere.

20. The plasma display apparatus of claim 19, wherein a duration of the turn-on period of the first sustain controller is proportional to a duration of a period when a voltage of the first electrode is maintained at the positive sustain voltage.

21. The plasma display apparatus of claim 19, wherein a magnitude of a current flowing into the inductor unit is 0 ampere during a turn-off period of the resonance controller.

22. The plasma display apparatus of claim 19, wherein the resonance controller is turned off while a current flows into the inductor unit.

23. The plasma display apparatus of claim 22, further comprising a bypass unit that allows a current flowing into the inductor unit to flow into the first sustain controller during a turn-off period of the resonance controller.

* * * * *